US005963169A

United States Patent [19]

Anderson et al.

[11] Patent Number: 5,963,169

[45] Date of Patent: Oct. 5, 1999

[54] MULTIPLE TUBE PLASMA ANTENNA

[75] Inventors: Theodore R. Anderson, West Greenwich, R.I.; Victor K. Choo, Rome, N.Y.

[73] Assignee: The United States of America as represented by the Secretary of the Navy, Washington, D.C.

[21] Appl. No.: 08/976,126

[22] Filed: Sep. 29, 1997

[51] Int. Cl.[6] ..... H01Q 1/26

[52] U.S. Cl. ..... 343/701; 343/785

[58] Field of Search ..... 343/701, 709, 343/785; 315/111.21, 111.41

[56] References Cited

U.S. PATENT DOCUMENTS

| | | | |
|---|---|---|---|
| 3,779,864 | 12/1973 | Kaw et al. | 176/1 |
| 3,914,766 | 10/1975 | Moore | 343/701 |
| 4,473,736 | 9/1984 | Bloyet et al. | 219/121 PM |
| 4,611,108 | 9/1986 | Leprince et al. | 315/111.21 |
| 5,594,456 | 1/1997 | Norris et al. | 343/701 |

FOREIGN PATENT DOCUMENTS

| | | | |
|---|---|---|---|
| 2554976 | 5/1985 | France | 343/701 |

*Primary Examiner*—Don Wong
*Assistant Examiner*—Tan Ho
*Attorney, Agent, or Firm*—Michael J. McGowan; Robert W. Gauthier; Prithvi C. Lall

[57] ABSTRACT

An antenna is provided in which electromagnetic signals in the High Frequency and Super High Frequency bands are propagated utilizing ionized gas, or plasma. Energized electrodes ionize the gas and the plasma is confined within non-metallic coaxial tubes contained within a non-metallic pressure vessel. Electric field gradients are used to change the shape and density of the plasma to affect the gain and directivity of the antenna. The inner plasma tube acts as the radiating source, while the outer plasma tube is used to change the radiation of the inner tube and to reflect the radiated signal. Instrumentation measures the density of the plasma providing a means to measure incoming signals as well as to regulate the radiation frequency.

22 Claims, 4 Drawing Sheets

MULTIPLE TUBE PLASMA ANTENNA

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to communications antennas, and more particularly to a plasma antenna for High Frequency (HF) communications.

(2) Description of the Prior Art

Current communication methods for underwater environments include the use of mast mounted antennas, towed buoys, and towed submersed arrays. While each of these methods has merits, each presents problems for use in an underwater environment. The mast of current underwater vehicles performs numerous sensing and optical functions. Mast mounted antenna systems occupy valuable space on the mast which could be used for other purposes. For both towed buoys and towed submersed arrays, speed must be decreased to operate the equipment.

Plasma antennas are of interest for communications with underwater vessels since the frequency, pattern and magnitude of the radiated signals are proportional to the rate at which the ions and electrons are displaced. The displacement and hence the radiated signal can be controlled by a number of factors including plasma density, tube geometry, gas type, current distribution, applied magnetic field and applied current. This allows the antenna to be physically small, in comparison with traditional antennas. Studies have been performed for characterizing electromagnetic wave propagation in plasmas. Therefore, the basic concepts, albeit for significantly different applications, have been investigated. These efforts have included a Corona Mode antenna that utilizes the corona discharges of a long wire to radiate ELF signals, a propane plasma antenna, and studies of electromagnetic propagation in plasmas. Other research has focused on characterizing the electromagnetic waves that exist in plasmas. In addition, U.S. Pat. No. 3,914,766 to Moore discloses a pulsating plasma antenna which has a cylindrical plasma column and a pair of field exciter members parallel to the column. The location and shape of the exciters, combined with the cylindrical configuration and natural resonant frequency of the plasma column, enhance the natural resonant frequency of the plasma column, enhance the energy transfer and stabilize the motion of the plasma so as to prevent unwanted oscillations and unwanted plasma waves from destroying the plasma confinement. However, as configured, the Moore antenna lacks the capability of being electronically steered and dynamically reconfigured. Such steering and reconfiguration would allow the antenna to be more efficient and operate in a wider band of frequencies. U.S. Pat. No. 5,594,456 to Noris et al. discloses an antenna device for transmitting a short pulse duration signal of predetermined radio frequency that includes a gas filled tube, a voltage source for developing an electrically conductive path along a length of the tube which corresponds to a resonant wavelength multiple of the predetermined radio frequency and a signal transmission source coupled to the tube which supplies the radio frequency signal. The antenna transmits the short pulse duration signal in a manner that eliminates a trailing antenna resonance signal. However, as with the Moore antenna, the band of frequencies at which the antenna operates is limited since the tube length is a function of the radiated signal.

SUMMARY OF THE INVENTION

Accordingly, it is an object of the present invention to provide a wideband, physically compact antenna capable of transmitting signals in a range from High Frequency (HF) to Super High Frequency (SHF).

Another object of the present invention is to provide an antenna that is electronically steerable and dynamically reconfigurable.

Still another object of the present invention is to provide an antenna which can be mounted within the mast structure of a submarine.

A further object of the present invention is to provide an antenna which can be generally formed into various shapes in order to conform to the structure to which it is attached.

Other objects and advantages of the present invention will become more obvious hereinafter in the specification and drawings.

In accordance with the present invention, an antenna is provided which utilizes ionized gas, or plasma, to propagate electromagnetic signals in the HF band. The gas is ionized using either lasers or electric potentials and the resulting plasma is confined within two or more coaxial tubes contained within a pressure vessel. Both the tubes and pressure vessel are non-metallic. External magnetic fields, temperature, or electric potentials are used to change the shape and directivity of the plasma to effect the gain and directivity of the antenna. Instrumentation measures the density of the plasma providing a means to measure incoming signals as well as to regulate the radiation frequency. The plasma antenna overcomes the frequency limitations of conventional antennas since the ion/electron movement within the plasma can be controlled by other than electromagnetic forces. This allows the plasma antenna to respond, i.e., radiate, signals at frequencies which do not require the frequency of the radiated signal to be a fractional part of an electromagnetic wavelength.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
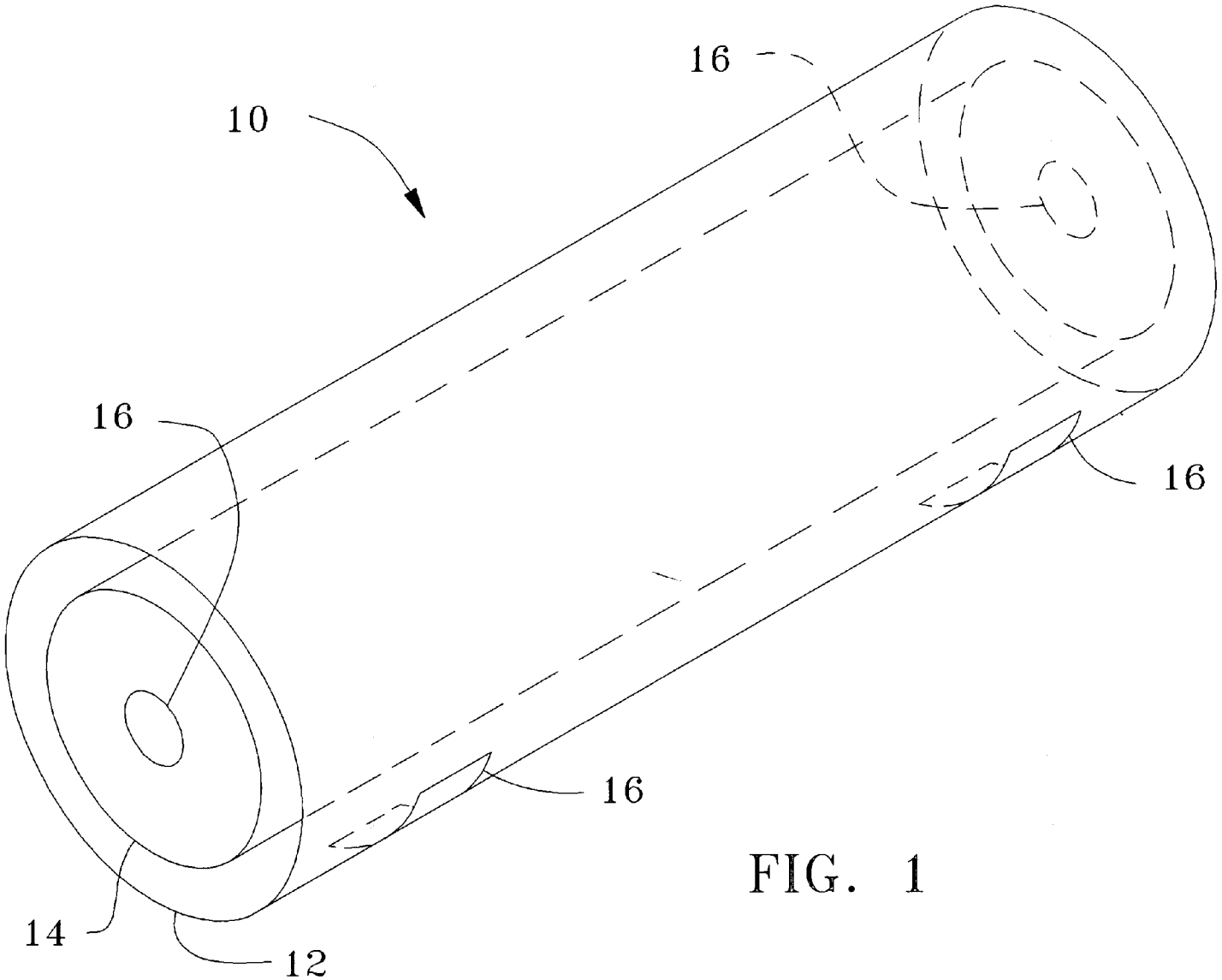
FIG. 1 is a representation of a plasma antenna of the present invention having a coaxial cylindrical tube design.

Referring now to FIG. 1, there is shown a representation of a plasma antenna 10 according to the present invention.

Plasma antenna 10 is a coaxial design having an inner plasma tube 12 to radiate the intended signal and an outer plasma tube 14 which can be used as a dynamically reconfigurable reflector. Plasma tubes 12 and 14 are constructed using well known electron/plasma tube construction techniques and may be fabricated from a variety of inert glasses also well known in the art. Voltage driven electrodes 16 are used to modulate the plasma density of inner and outer tubes 12 and 14, thus creating plasma waves which in turn are converted to electromagnetic waves for radiating a signal. The conversion process is well known in the art and is described in various works, e.g., "Radiative Properties of a Plasma Moving Across a Magnetic Field 1. Theoretical Analysis," Roussel-Dupre', R. and Miller, R., *Phys. Fluids B* 5(4), April 1993. The electrodes vary the plasma density by increasing the number of ions and free electrons in the tube. The potential difference excites the electrons and allows them to move into an energy state that is sufficient to break free of the parent molecule (or atom), thus producing a free electron and ionized gas.

In addition to passing signals, plasma antennas are capable of reflecting electromagnetic signals. The reflection properties of plasma are also well known and described in the art, e.g., *Principles of Plasma Physics*, Krall, N., McGraw-Hill, 1973. The reflection/transmission property of plasma is relevant to the design of an antenna since the phenomena can be used as a reflector to re-direct a radar signal radiated by a driving antenna. Such a reflector is discussed in "Navy Research Lab Tests Plasma Antenna," Nordwall, B., *Aviation Week and Space Technology*, Jun. 10, 1996. Here, the plasma sheet could be steered electronically resulting in a fast, multi-functional, antenna reflector. Another potential application of the reflective/transmission properties of the plasma is the reduction of the radar cross section of an antenna. The plasma's transmission properties will reduce the radar cross section as long as the plasma antenna is operating at a frequency below that of search radars. For a number of vessels, the antenna mounting structure typically would reflect more radar signals than the actual antenna element such that the radar cross section reduction may not be significant. However, significant reductions may be obtained for submerged vessels where the antenna is mounted on top of a mast extending above the water surface, or is mounted as a conformal antenna on a radar transparent, or stealth, sail area of the submerged vessel. A reduced radar cross section is probably of greater importance for surface ships since these antennas tend to be relatively large and may contribute significantly to the radar cross section of the ship. Controlling the plasma density within the outer tube allows the outer tube to be used as a reflector to direct the radiation pattern of the inner tube and to reduce the radar cross section of the antenna.

Figure 2:
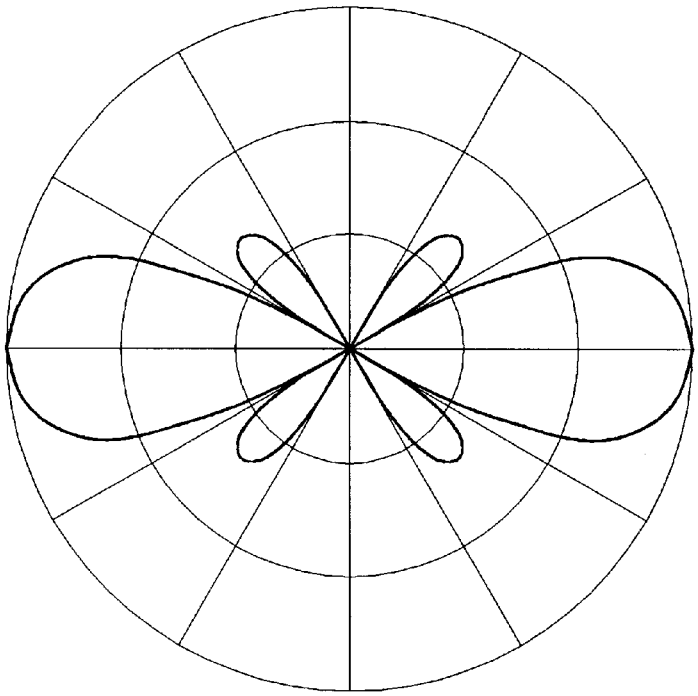
FIG. 2 shows a computed radiation pattern of a plasma antenna having a simple tube design.
Figure 3:
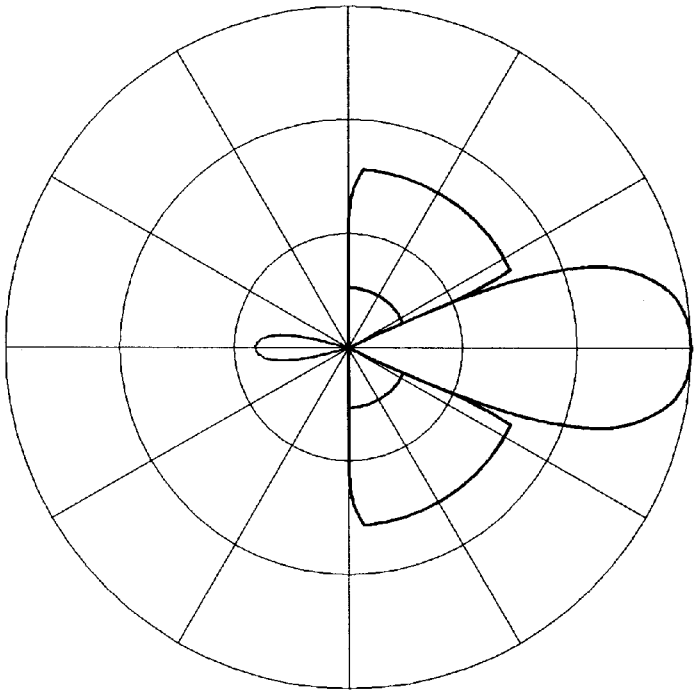
FIG. 3 shows a computed radiation pattern of a plasma antenna of the present invention.

FIG. 2 illustrates the computed radiation pattern for a $3\lambda$, plasma line antenna, where $\lambda$ is the wavelength of interest. The current distribution for the radiation pattern consists of a cosine on a pedestal, i.e., there is an offset of the cosine wave near the electrodes. The resulting beam width of the plasma line is approximately 18 degrees and has distinct side lobes. FIG. 3 illustrates the computed radiation pattern for a $3\lambda$ line antenna using the outer tube as a reflector that has an efficiency of 85%. As can be seen, the outer tube reflector will significantly reduce the back lobe and concentrates the energy towards the front of the antenna.

Figure 4:
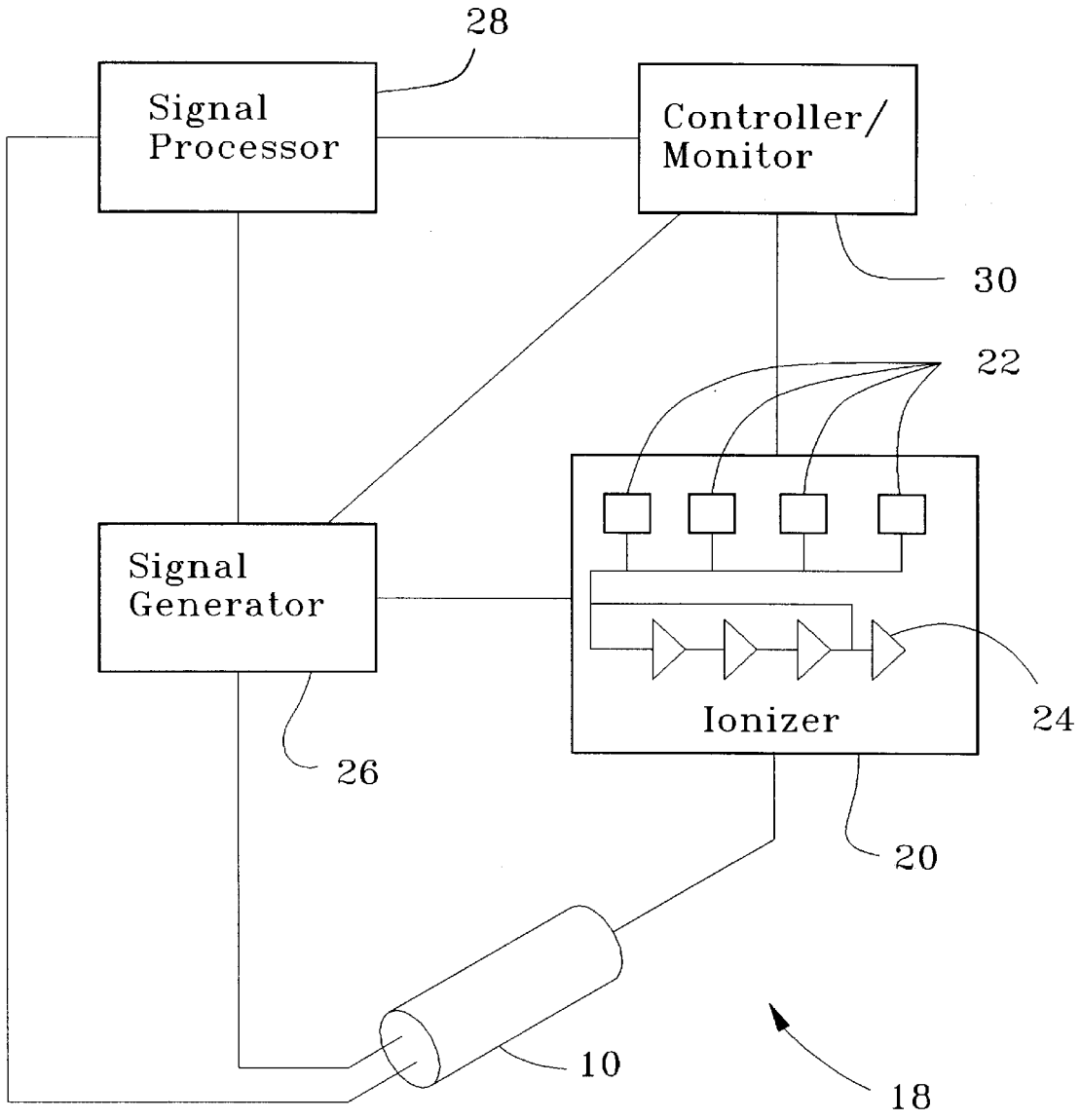
FIG. 4 is a schematic representation of an antenna system having a plasma antenna of the present invention.

Referring now to FIG. 4, there is shown a schematic representation of a plasma antenna system 18 utilizing plasma antenna 10 of FIG. 1. Ionizer module 20 is responsible for creating and maintaining the ion concentration within plasma antenna 10. In the preferred embodiment of FIG. 1, energized electrodes 16 of FIG. 1 are used to ionize the plasma. However, ionization can be achieved by several methods including electric potential difference, photoionization by the use of lasers, RF heating, discharge and magnetic squeezing under magnetic confinement. The electrode method is the desired approach since it provides the greatest amount of flexibility, in terms of variability and controllability, and is the easiest and most efficient method to implement. Depending on the application, ionizer module 20 may have a number of power supplies 22 ranging from one to the number of electrodes 16. It is anticipated that a single supply would be sufficient for most applications. Ionizer module 20 also contains a series of attenuator networks 24 that allows each electrode 16 to receive a different voltage level. In the transmission mode, signal generator or transmission module 26 converts the transmission signals into a format suitable for plasma antenna 10 by modulating plasma frequencies as is well known in the art, such as by alternating the magnetic field in the antenna tube through a series of electromagnets or wire coils. In the receiving mode, receiver 28 measures signals arriving at plasma antenna 10, again using methods well known in the art, such as a sensing wire, or cathode follower, within the plasma. The operation of ionizer module 20, signal generator 26 receiver 28 are controlled and monitored by controller module 30. In a preferred embodiment, controller module 30 has a microprocessor for performing the control and monitoring functions, including controlling the attenuator paths and power supply levels.

Figure 5:
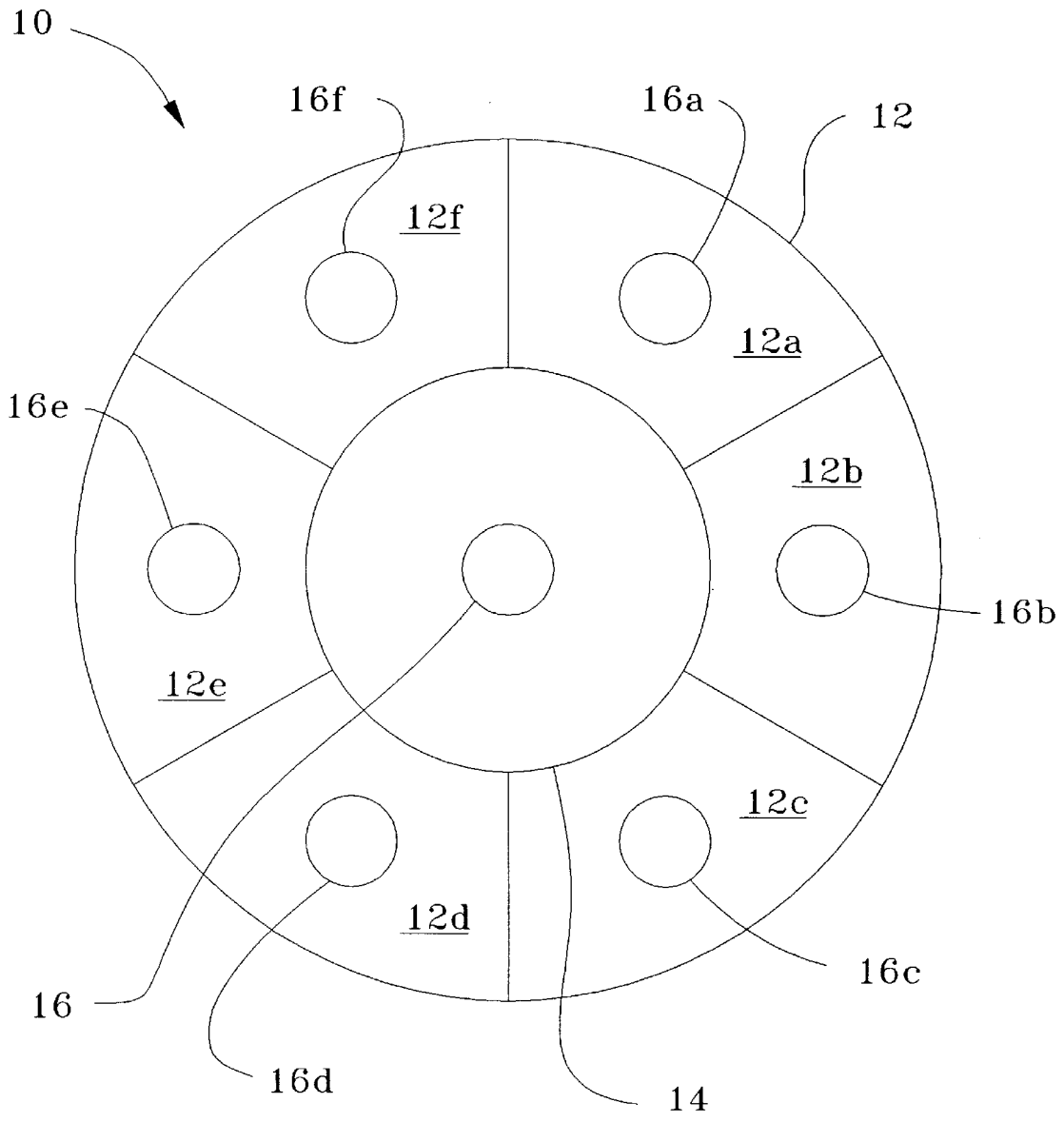
FIG. 5 is a cross section of an alternate embodiment of a plasma antenna of the present invention having a multi-chambered outer tube.

Though the plasma antenna of the present invention has been shown as cylindrical, it will be understood that the tubes may have any cross section, e.g., square or rectangular. Such shapes will effect the radiation and reflectivity patterns for the antenna. While such tubes may be more difficult to fabricate in comparison to cylindrical tubes, the planar surfaces may allow finer control of plasma density. Referring now to FIG. 5, a cross section of an alternate embodiment of the antenna of FIG. 1 is shown. Outer tube 12 is divided into six separate chambers 12*a* though 12*f* and each chamber is provided with electrodes, 16*a* through 16*f*, respectively, to independently control the plasma densities within the chambers 12*a–f*. Such a configuration allows more precise control of the plasma density within outer tube 12 and thus greater control of the radiation pattern of antenna 10.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An antenna system comprising:

a first non-metallic tube;

a first ionized gas contained within the first tube, the first ionized gas providing a first antenna field;

a second non-metallic tube surrounding and spaced apart from the first tube;

a second ionized gas contained within a space between the first and second tubes, the second ionized gas providing a second antenna field;

means for controlling densities of the first and second ionized gases within the first and second tubes, the controlled densities shaping the first and second antenna fields.

2. The antenna system of claim 1 wherein said density controlling means comprises a plurality of voltage driven electrodes.

3. The system of claim 2 wherein said controlling means further comprises a plurality of power supplies, each power supply corresponding to one of the voltage driven electrodes.

4. The system of claim 2 wherein said controlling means further comprises a series of attenuator networks for providing each of the plurality of voltage driven electrodes with a distinct voltage level.

5. The antenna system of claim 1 wherein the first and second tubes are cylindrically shaped and coaxial.

6. The antenna system of claim 1 wherein the first and second tubes are contained within a nonmetallic pressure vessel for operation of the antenna system in a high pressure environment.

7. The antenna system of claim 1 wherein the density controlling means acts on the second ionized gas to selectively reflect portions of the first antenna field.

8. The system of claim 1 further comprising an ionizer for ionizing the first and second ionized gas.

9. The system of claim 8 wherein said ionizer further comprises energized electrodes.

10. The system of claim 1 wherein the second tube is comprised of a plurality of separate chambers containing the second ionized gas, the controlling means independently controlling the density of the second ionized gas within each chamber.

11. The antenna system of claim 10 wherein said density controlling means comprises a plurality of voltage driven electrodes corresponding to the first tube and the plurality of separate chambers of the second tube.

12. An antenna system for transmitting and receiving signals, the system comprising:

at least two concentric plasma columns;

at least two concentric non-metallic tubes, each plasma column separated from each adjacent plasma column by one of the non-metallic tubes so as to form plasma tubes; and an ionizer for establishing the plasma within the tubes, a density of each plasma tube determining the transmitted and received signals.

13. The antenna system of claim 12 further comprising a controller for modulating the plasma densities within a first inner of the plasma tubes and a second outer of the plasma tubes, the plasma density within the first tube corresponding to the transmitted signal, the plasma density within the second tube selectively reflecting portions of the transmitted signal.

14. The antenna system of claim 13 wherein the controller further comprises a signal generator for receiving the transmitted signal and converting the transmitted signal to a modulated plasma frequency signal, the ionizer acting on the modulated plasma frequency signal to modulate a level of ionization within the first plasma tube.

15. The antenna system of claim 14 further comprising a receiver for detecting changes in the plasma density within the first tube corresponding to the received signal.

16. The antenna system of claim 12 further comprising a receiver for detecting changes in the plasma density corresponding to the received signal.

17. The antenna system of claim 12 wherein the ionizer further comprises a plurality of voltage driven electrodes.

18. The antenna system of claim 17 wherein the ionizer further comprises at least one power supply for selectively providing power to each one of the plurality of electrodes.

19. The antenna system of claim 18 wherein the ionizer further comprises a series of attenuators for providing a distinct voltage level to each one of the plurality of electrodes.

20. An antenna system comprising:

a first antenna providing a first antenna field;

a non-metallic tube surrounding and spaced apart from the first antenna;

an ionized gas contained within a space between the first antenna and the non-metallic tube, the ionized gas providing a second antenna field;

means for controlling a density of the ionized gas, the controlled density shaping the first and second antenna fields.

21. The system of claim 20 wherein the non-metallic tube is comprised of a plurality of separate chambers each containing the ionized gas, the controlling means independently controlling the density of the ionized gas within each chamber.

22. The antenna system of claim 21 wherein said density controlling means comprises a plurality of voltage driven electrodes corresponding to the plurality of separate chambers.

* * * * *

UNITED STATES PATENT AND TRADEMARK OFFICE

CERTIFICATE OF CORRECTION

PATENT NO. : 5,963,169
DATED : October 15, 1999
INVENTOR(S) : Theodore R. Anderson et al.

It is certified that error appears in the above-identified patent and that said Letters Patent is hereby corrected as shown below:

Column 3,
Line 2, “12” should read -- 14 --
Line 3, “14” should read -- 12 --
Line 9, “12 and 14” should read -- 14 and 12 --

Signed and Sealed this

Eighteenth Day of November, 2003

JAMES E. ROGAN
*Director of the United States Patent and Trademark Office*